US010612353B2

(12) United States Patent
Getzlaf et al.

(10) Patent No.: US 10,612,353 B2
(45) Date of Patent: Apr. 7, 2020

(54) DOWNHOLE FLOW CONTROL APPARATUS

(71) Applicant: NCS MULTISTAGE INC., Calgary (CA)

(72) Inventors: Don Getzlaf, Calgary (CA); John Edward Ravensbergen, Calgary (CA); Brock Gillis, Calgary (CA); Michael Werries, Calgary (CA)

(73) Assignee: NCS Multistage Inc., Calgary (CA)

( * ) Notice: Subject to any disclaimer, the term of this patent is extended or adjusted under 35 U.S.C. 154(b) by 592 days.

(21) Appl. No.: 15/151,799

(22) Filed: May 11, 2016

(65) Prior Publication Data

US 2016/0333679 A1 Nov. 17, 2016

Related U.S. Application Data

(60) Provisional application No. 62/159,808, filed on May 11, 2015.

(51) Int. Cl.

| | |
|---|---|
| ***E21B 43/25*** | (2006.01) |
| ***E21B 34/10*** | (2006.01) |
| *E21B 34/00* | (2006.01) |

(52) U.S. Cl.

CPC ..... *E21B 43/255* (2013.01); *E21B 34/10* (2013.01); *E21B 2034/007* (2013.01)

(58) Field of Classification Search

CPC ..... E21B 43/255; E21B 34/10
USPC ..... 166/305.1
See application file for complete search history.

(56) References Cited

U.S. PATENT DOCUMENTS

| | | | | |
|---|---|---|---|---|
| 4,510,995 | A | 4/1985 | Krause, Jr. et al. | |
| 4,583,591 | A | 4/1986 | Krause, Jr. et al. | |
| 6,464,006 | B2 | 10/2002 | Womble | |
| 7,640,989 | B2 | 1/2010 | Williamson, Jr. et al. | |
| 7,730,954 | B2 | 6/2010 | Schultz et al. | |
| 8,006,952 | B2 | 8/2011 | Wygnanski | |
| 8,267,178 | B1 | 9/2012 | Sommers et al. | |
| 8,297,367 | B2 | 10/2012 | Chen et al. | |
| 8,646,537 | B2 | 2/2014 | Tips et al. | |
| 8,757,265 | B1 | 6/2014 | Cuffe et al. | |
| 2007/0204995 | A1 | 9/2007 | Hofman et al. | |
| 2007/0240880 | A1* | 10/2007 | Olsen | E21B 43/006 166/259 |
| 2009/0151790 | A1 | 6/2009 | Ranjan et al. | |
| 2010/0314562 | A1 | 12/2010 | Bisset | |

(Continued)

FOREIGN PATENT DOCUMENTS

| | | | |
|---|---|---|---|
| WO | 2007003597 | A1 | 1/2007 |
| WO | 2014046841 | A2 | 3/2014 |
| WO | 2014060722 | A2 | 4/2014 |

OTHER PUBLICATIONS

WIPO, International Search Report and Written Opinion for PCT Application No. PCT/CA2016/000137 dated Jul. 25, 2016.

*Primary Examiner* — Zakiya W Bates
*Assistant Examiner* — Ashish K Varma
(74) *Attorney, Agent, or Firm* — Ridout & Maybee LLP

(57) ABSTRACT

There is provided a downhole flow control apparatus comprising: a housing; a port extending through the housing; a passage disposed within the housing for conducting material to and from the port; a flow control member displaceable relative to the port; and a flow control member actuator configured for producing a pressurized fluid for urging the displacement of the flow control member.

4 Claims, 4 Drawing Sheets

(56) References Cited

U.S. PATENT DOCUMENTS

| | | | | |
|---|---|---|---|---|
| 2012/0138311 | A1* | 6/2012 | Stout | E21B 34/10 166/373 |
| 2013/0080063 | A1 | 3/2013 | Pillai et al. | |
| 2014/0034310 | A1 | 2/2014 | Andersen | |
| 2014/0083689 | A1 | 3/2014 | Streich et al. | |
| 2014/0102708 | A1 | 4/2014 | Purkis et al. | |
| 2014/0182856 | A1* | 7/2014 | Gano | E21B 34/06 166/306 |

* cited by examiner

DOWNHOLE FLOW CONTROL APPARATUS

FIELD

The present disclosure relates to downhole tools which are deployable within a wellbore for controlling supply of treatment fluid to the reservoir.

BACKGROUND

Mechanical actuation of downhole flow control apparatuses can be relatively difficult, owing to the difficulty in deploying shifting tools on coiled tubing, or conventional ball drop systems, for actuating such valves, especially in deviated wellbores. When using conventional ball drop systems, the number of stages that are able to be treated are limited.

SUMMARY

In one aspect, there is provided a downhole flow control apparatus comprising: a housing; a port extending through the housing; a passage disposed within the housing for conducting material to and from the port; a flow control member displaceable relative to the port; and a flow control member actuator configured for producing a pressurized fluid for urging the displacement of the flow control member.

In another aspect, there is provided a method of stimulating production from a subterranean formation comprising: generating gaseous material with a downhole gas generator such that the generated gaseous material becomes disposed in fluid communication with a flow control member of a fluid communication station disposed within a wellbore of the subterranean formation; and displacing the flow control member, relative to a port, with the generated gaseous material, such that the port becomes opened; and stimulating the subterranean formation via the opened port.

In another aspect, there is provided a method of stimulating production from a subterranean formation comprising: deploying a first fluid communication station and a second fluid communication station within a wellbore of the subterranean formation, wherein each one of the first and second fluid communication stations, independently, is configured to selectively establish fluid communication between the wellbore and the subterranean formation; generating gaseous material with a downhole gas generator such that the generated gaseous material becomes disposed in fluid communication with a flow control member of the first fluid communication station while fluid communication between the generated gaseous material and a flow control member of the second fluid communication station is sealed or substantially sealed, such that displacement of the flow control member of the first fluid communication station, relative to a port, is effected by the generated gaseous material, such that the port becomes opened and fluid communication is established between the wellbore and the subterranean formation via the first fluid communication station; after the fluid communication is established between the wellbore and the subterranean formation via the first fluid communication station, stimulating the subterranean formation via the first fluid communication station; generating gaseous material with a downhole gas generator such that the generated gaseous material becomes disposed in fluid communication with the flow control member of the first fluid communication station while fluid communication between the generated gaseous material and the flow control member of the second fluid communication station is sealed or substantially sealed, such that displacement of the flow control member of the first fluid communication station, relative to a port, is effected by the generated gaseous material, such that the port becomes closed and fluid communication between the wellbore and the subterranean formation, via the first fluid communication station, becomes sealed or substantially sealed; generating gaseous material with a downhole gas generator such that the generated gaseous material becomes disposed in fluid communication with the flow control member of the second fluid communication station while fluid communication between the generated gaseous material and the flow control member of the first fluid communication station is sealed or substantially sealed, such that displacement of the flow control member of the second fluid communication station, relative to a port, is effected by the generated gaseous material, such that the port becomes opened and fluid communication is established between the wellbore and the subterranean formation via the second fluid communication station; after the fluid communication is established between the wellbore and the subterranean formation via the second fluid communication station, stimulating the subterranean formation via the second fluid communication station; and generating gaseous material with a downhole gas generator such that the generated gaseous material becomes disposed in fluid communication with the flow control member of the second fluid communication station while fluid communication between the generated gaseous material and the flow control member of the first fluid communication station is sealed or substantially sealed, such that displacement of the flow control member of the second fluid communication station, relative to a port, is effected by the generated gaseous material, such that the port becomes closed and fluid communication between the wellbore and the subterranean formation, via the second fluid communication station, becomes sealed or substantially sealed.

In another aspect, there is provided a downhole flow control apparatus comprising; a housing; a port extending through the housing; a passage disposed within the housing for conducting material to and from the port; a flow control member displaceable relative to the port for effecting opening of the port; a flow control member actuator configured for effecting the displacement of the flow control member; and a controller configured to determine completion of a wellbore stimulation stage, and upon the determination, to operate the flow control member actuator to effect the displacement of the flow control member such that the port becomes opened.

In another aspect, there is provided a downhole flow control apparatus comprising: a housing; a port extending through the housing; a passage disposed within the housing for conducting material to and from the port; a flow control member displaceable relative to the port for effecting opening of the port; a flow control member actuator configured for effecting the displacement of the flow control member; and a controller configured to determine that a predetermined time interval has expired following completion of a wellbore stimulation stage, and upon the determination, to operate the flow control member actuator to effect displacement of the flow control member such that the port becomes opened.

In another aspect, there is provided a downhole flow control apparatus comprising: a housing; a port extending through the housing; a passage disposed within the housing for conducting material to and from the port; a flow control member displaceable relative to the port for effecting opening of the port; a flow control member actuator configured for effecting the displacement of the flow control member; a sensor for sensing completion of a wellbore stimulation stage; and a controller configured to maintain a count of completed wellbore stimulation stages, and, in response to the sensing of completion of a wellbore stimulation stage, to operate the flow control member actuator to effect displacement of the flow control member such that the port becomes opened.

In another aspect, there is provided a downhole flow control apparatus comprising; a housing; a port extending through the housing; a passage disposed within the housing for conducting material to and from the port; a flow control member displaceable relative to the port for effecting opening of the port; a flow control member actuator configured for effecting the displacement of the flow control member; a sensor for sensing completion of a wellbore stimulation stage; and a controller configured to maintain a count of completed wellbore stimulation stages and to operate the flow control member actuator to effect displacement of the flow control member after expiration of a timed interval following a predetermined number of completed wellbore stimulation stages.

In another aspect, there is provided a method of stimulating production of a subterranean formation, comprising: supplying treatment material to a first zone of a subterranean formation such that a wellbore treatment stage is effected; sensing completion of the wellbore treatment stage with a sensor of a fluid communication station disposed within a wellbore for effecting supply of treatment material to a second zone of the subterranean formation; and based on at least the sensing, displacing a flow control member of the fluid communication station such that a port of the fluid communication zone becomes opened for supplying treatment material to the second zone.

BRIEF DESCRIPTION OF DRAWINGS

The preferred embodiments will now be described with the following accompanying drawings, in which.

DETAILED DESCRIPTION

Figure 1:
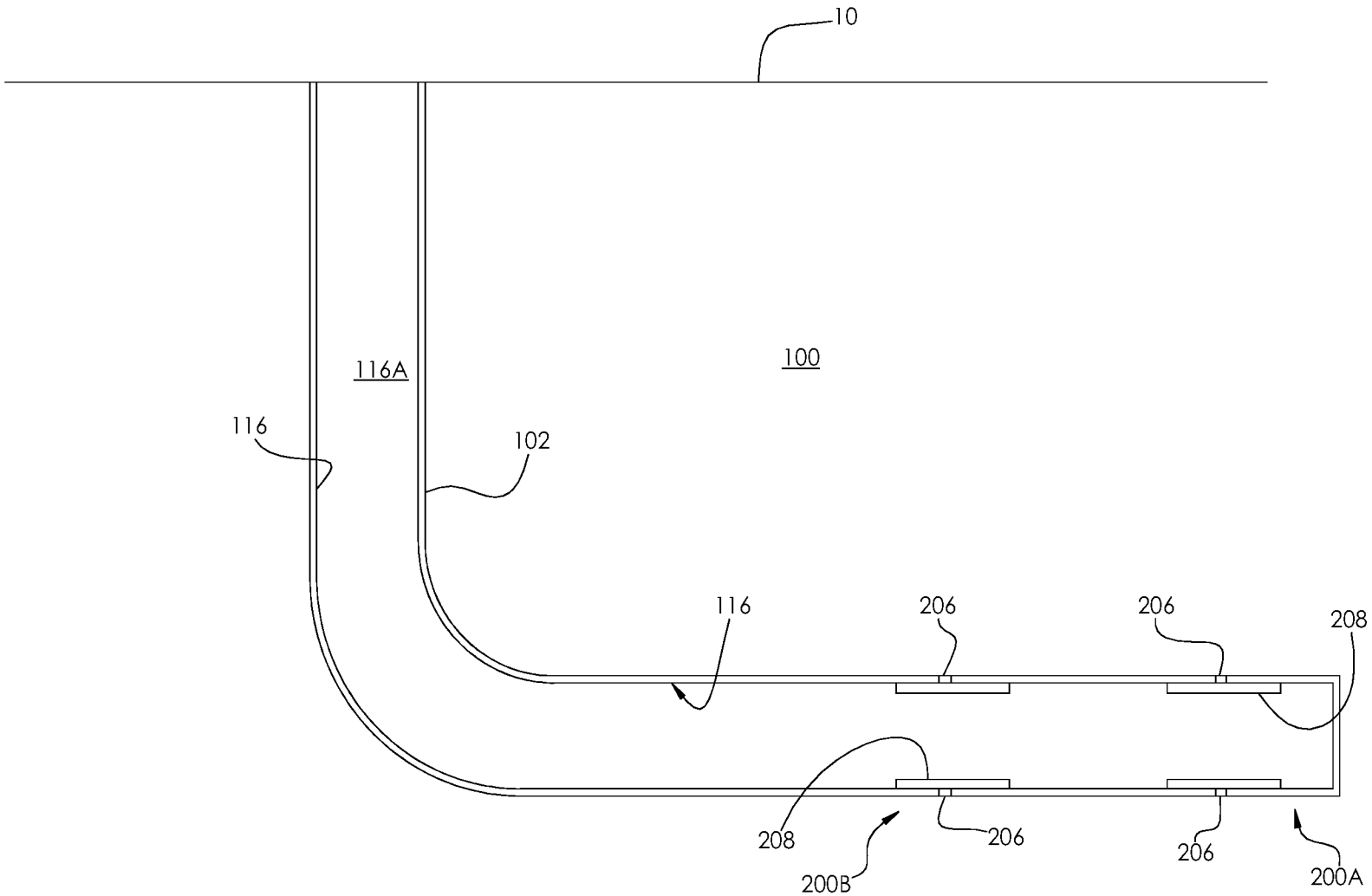
FIG. 1 is a schematic illustration of a system for effecting fluid communication between the surface and a subterranean formation via a wellbore.

Referring to FIG. 1, there is provided a wellbore material transfer system for conducting material to a subterranean formation 100 via a wellbore 102, from a subterranean formation 100 via a wellbore 102, or both to and from a subterranean formation 100 via a wellbore 102. In some embodiments, for example, the subterranean formation 100 is a hydrocarbon material-containing reservoir.

In some embodiments, for example, the conducting (such as, for example, by flowing) material to a subterranean formation 100 via a wellbore 102 is for effecting selective stimulation of a hydrocarbon material-containing reservoir. The stimulation is effected by supplying treatment material to the hydrocarbon material-containing reservoir. In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir. In some embodiments, for example, the treatment material includes water, and is supplied to effect waterflooding of the reservoir.

In some embodiments, for example, the conducting (such as, for example, by flowing) material from a subterranean formation 100 via a wellbore 102 is for effecting production of hydrocarbon material from the hydrocarbon material-containing reservoir. In some of these embodiments, for example, the hydrocarbon material-containing reservoir, whose hydrocarbon material is being produced by the conducting via the wellbore 102, has been, prior to the producing, stimulated by the supplying of treatment material to the hydrocarbon material-containing reservoir.

In some embodiments, for example, the conducting to the subterranean formation 100 from the wellbore 102, or from the subterranean formation 100 to the wellbore 102, is effected via one or more flow communication stations (two (2) are shown, and identified by reference numerals 200A, 200B) that are disposed at the interface between the subterranean formation 100 and the wellbore 102. In some embodiments, for example, the flow communication stations are integrated within a wellbore string 116 that is deployed within the wellbore 102. Integration may be effected, for example, by way of threading or welding.

The wellbore string 116 includes one or more of pipe, casing, and liner, and may also include various forms of tubular segments, such as the flow control apparatuses 202 described herein. The wellbore string 116 defines a wellbore string passage 116A. In some embodiments, for example, the flow communication station 200 is integratable within the wellbore string 116 by a threaded connection.

Successive flow communication stations 200 may be spaced from each other along the wellbore string 116 such that each flow communication stations 200 is positioned adjacent a zone or interval of the subterranean formation 100 for effecting flow communication between the wellbore 102 and the zone (or interval).

For effecting the flow communication, the fluid communication station 200 includes a downhole flow control apparatus 201.

Referring to FIGS. 2 to 5, in some embodiments, for example, the downhole flow control apparatus 201 includes a housing 202, an apparatus passage 204, one or more ports 206, and a flow control member 208.

The housing 202 is configured for coupling (such as, for example, by threadable coupling) to the wellbore string 116. The wellbore string 116 is lining the wellbore 102. The wellbore string 116 is provided for, amongst other things, supporting the subterranean formation 100 within which the wellbore 102 is disposed. The wellbore string 116 may include multiple segments, and segments may be connected (such as by a threaded connection).

The one or more ports 206 extends through the housing 202. In those embodiments where the apparatus 201 includes a plurality of ports 206, the plurality of ports are disposed about the periphery of the housing 202 and are equally, or substantially equally, spaced apart relative to one another. The one or more ports 206 are provided for effecting fluid communication between the wellbore 102 and the subterranean formation 100.

In some embodiments, for example, it is desirable for the treatment material, being supplied to the wellbore 102 through the at least one port 206, be supplied, or at least substantially supplied, within a definite zone (or "interval") of the subterranean formation 100 in the vicinity of the at least one port 206. In this respect, the system may be configured to prevent, or at least interfere, with conduction of the treatment material, that is supplied to one zone of the subterranean formation 100, to a remote zone of the subterranean formation 100. In some embodiments, for example, such undesired conduction to a remote zone of the subterranean formation 100 may be effected through an annulus, that is formed within the wellbore 102, between the wellbore string 116 and the subterranean formation 100. To prevent, or at least interfere, with conduction of the supplied treatment material to a zone of interval of the subterranean formation 100 that is remote from the zone or interval of the subterranean formation to which it is intended that the treatment material is supplied, fluid communication, through the annulus, between the port and the remote zone, is prevented, or substantially prevented, or at least interfered with, by a zonal isolation material. In some embodiments, for example, the zonal isolation material includes cement, and, in such cases, during installation of the assembly within the wellbore, the wellbore string is cemented to the subterranean formation, and the resulting system is referred to as a cemented completion.

To at least mitigate ingress of cement during cementing, and also at least mitigate curing of cement in space that is in proximity to the at least one port 206, or of any cement that has become disposed within the port, prior to cementing, the port may be filled with a viscous liquid material having a viscosity of at least 100 mm2/s at 40 degrees Celsius. Suitable viscous liquid materials include encapsulated cement retardant or grease. An exemplary grease is SKF LGHP 2™ grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

The apparatus passage 204 is defined within the housing 202, and extends longitudinally between first and second ends 202D, 202E. When the flow control apparatus 201 is integrated within the wellbore string 116, the apparatus passage 204 forms part of the wellbore string passage 116A.

Figure 2:
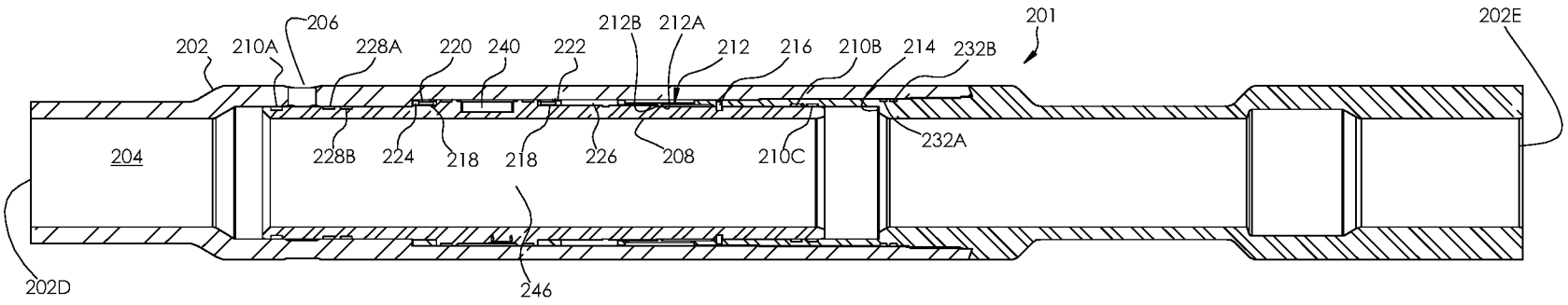
FIG. 2 is a side sectional elevation view of an embodiment of a downhole flow control apparatus, with the flow control member disposed in the closed position.
Figure 3:
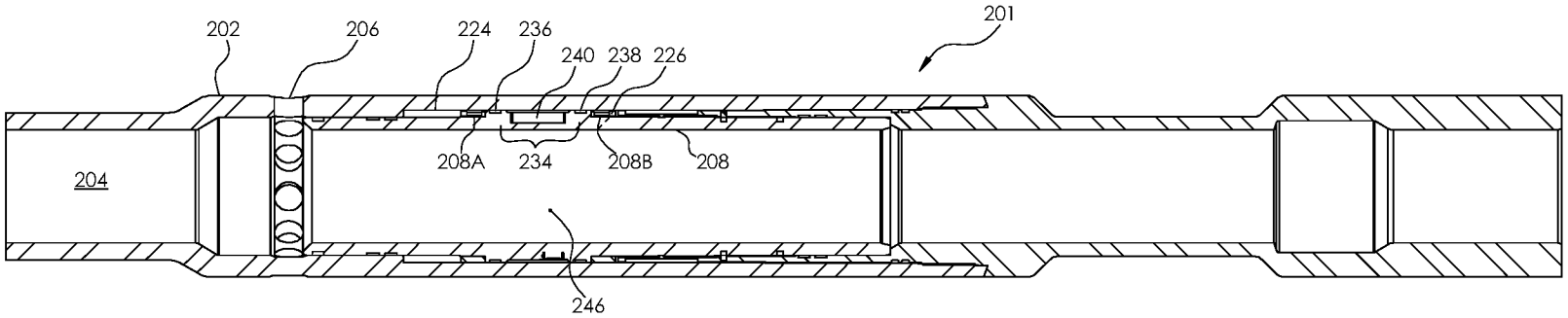
FIG. 3 is a side sectional elevation view of the downhole flow control apparatus illustrated in FIG. 2, with the flow control member disposed in the open position.
Figure 4:
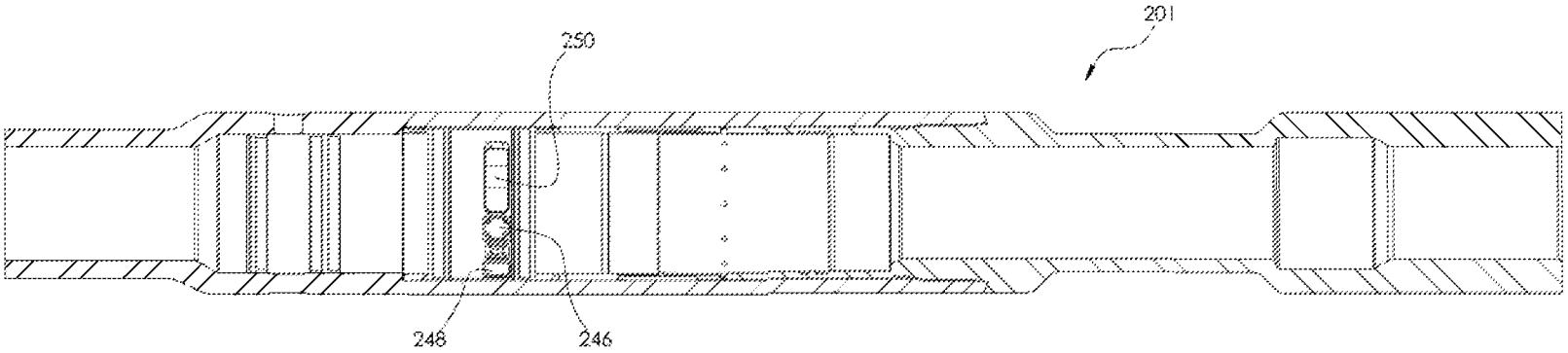
FIG. 4 is identical to FIGS. 2 and 3, with the exception that the flow control member has not been sectioned in FIG. 4.
Figure 5:
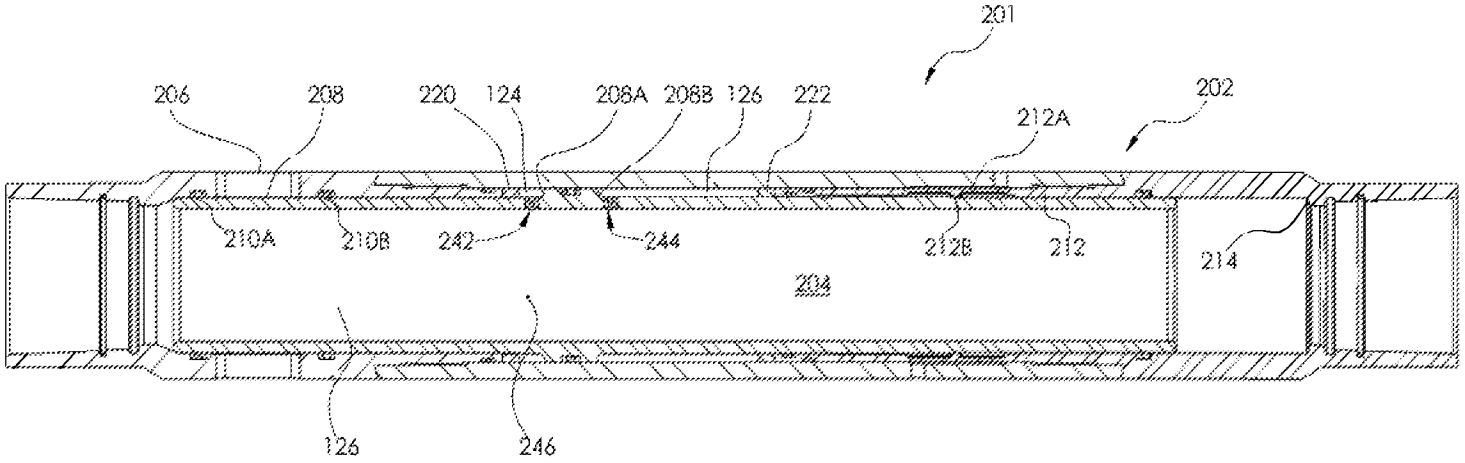
FIG. 5 is a side sectional elevation view of another embodiment of a downhole flow control apparatus, with the flow control member disposed in the closed position.

The flow control member 208 is provided for controlling the conducting of material by the flow control apparatus 201, through the passage 104, via the one or more ports 206. The flow control member 208 is displaceable, relative to the one or more ports 206, for effecting opening of the one or more ports 206. In some embodiments, for example, the flow control member 208 is also displaceable, relative to the one or more ports 206, for effecting closing of the one or more ports 206. In this respect, the flow control member 208 is displaceable such that the flow control member 208 is positionable between open and closed positions. Referring to FIG. 3, the open position of the flow control member 208 corresponds to an open condition of the one or more ports 206. Referring to FIGS. 2 and 5, the closed position of the flow control member 208 corresponds to a closed condition of the one or more ports 206. In some embodiments, for example, in the closed position, the one or more ports 206 are covered by the flow control member 208, and the displacement of the flow control member 208 to the open position effects at least a partial uncovering of the one or more ports 206 such that the 118 becomes disposed in the open condition.

The flow control member 208 is configured for displacement, relative to the at least one port 206, from the closed position to the open position in response to application of a sufficient net opening force. In some embodiments, for example, the application of a sufficient net opening force is effected by a fluid pressure differential. While disposed in the open position, the flow control member 208 is configured for displacement, relative to the at least one port 206, from the open position to the closed position in response to application of a sufficient net closing force. In some embodiments, for example, the application of a sufficient net closing force is effected by a fluid pressure differential.

In some embodiments, for example, the flow control member 208, the one or more ports 206, and the apparatus passage 204 are co-operatively configured such that, while the flow control apparatus 201 is disposed within a wellbore 102, the displaceability of the flow control member 208 relative to the one or more ports 206 is such that a change in the degree of interference to fluid communication, via the one or more ports 206, between the subterranean formation 100 and the apparatus passage 204, is effected by the displacement.

In some embodiments, for example, the flow control member 208, the one or more ports 206, and the apparatus passage 204 are co-operatively configured such that, while: (i) the flow control apparatus 201 is disposed within a wellbore, and (ii) treatment material is being flowed through the apparatus passage 204, the displaceability of the flow control member 208 relative to the one or more ports 206 is such that a change in at least the degree of restriction to fluid flow, via the one or more ports 206, between the subterranean formation 100 and the apparatus passage 204, is effected by the displacement.

In some embodiments, for example, the flow control member 208, the one or more ports 206, and the apparatus passage 204 are co-operatively configured such that, while: (i) the flow control apparatus 201 is disposed within a wellbore, and (ii) the flow control member 208 is disposed in the closed position, a sealing interface 234 is defined such that fluid communication, via the one or more ports 206, between the subterranean formation 100 and the apparatus passage 204, is sealed or substantially sealed. Relatedly, while: (i) the flow control apparatus 201 is disposed within a wellbore, and (ii) the flow control member 208 is disposed in the open position, the apparatus passage 204 is disposed in fluid communication with the subterranean formation via the one or more ports 206. In this respect, while: (i) the flow control apparatus 201 is disposed within a wellbore, and (ii) the flow control member 208 is disposed in the open position, fluid is conductible between the apparatus passage 204 and the subterranean formation 100 via the one or more ports 206.

In some embodiments, for example, the sealing interface 234 is established by sealing engagement between the flow control member 208 and the housing 202. In this respect, the housing 202 includes a sealing surface configured for sealing engagement with a flow control member 208 (see below). In some embodiments, for example, the sealing surface is defined by sealing members 210A, 210B of the housing 202. In some embodiments, for example, when a flow control member 208 is disposed in the closed position, corresponding to the closed condition of the one or more ports 206, each one of the sealing members 210A, 210B, is, independently, disposed in sealing, or substantially sealing, engagement with the flow control member 208. The sealing, or substantially sealing, engagement effects sealing, or substantial sealing, of fluid communication between the subterranean formation 100 and the passage 204 via the one or more ports 206. In some embodiments, for example, each one of the sealing members 210A, 210B, independently, includes an o-ring. In some embodiments, for example, each one of the sealing members 210A, 210B, independently, is defined by a molded sealing member. The port 206 is disposed between the sealing members 210A, 210B. In some embodiments, for example, the port 206 extends through the housing 202. During stimulation, the port 206 effects fluid communication between the passage 204 and the wellbore. In this respect, during stimulation, treatment material being conducted from the treatment material source via the passage 204 is supplied to the wellbore 102 through the port 206.

The flow control member 208 co-operates with the sealing members 210A, 210B to effect opening and closing of the port 206. When the at least one port 206 is disposed in the closed condition, the flow control member 208 is sealingly engaged to both of the sealing surfaces 210A, 210B, and preventing, or substantially preventing, fluid flow, via the at least one port 206, between the passage 204 and the subterranean formation 100. When the at least one port 206 is disposed in the open condition, the flow control member 208 is spaced apart or retracted from at least one of the sealing members (such as the sealing surface 210A), thereby providing a passage for fluid communication the passage 104 and the subterranean formation 100.

In some embodiments, for example, the flow control member 208 includes a sleeve. The sleeve is slideably disposed within the apparatus passage 204.

In some embodiments, for example, a flow control member-engaging collet extends from the housing 202 and is configured to releasably engage the flow control member 108 for resisting a change in position of the flow control member 208. In this respect, in some embodiments, for example, the flow control member-engaging collet 212 includes at least one collet finger 212A (such as a plurality of collet fingers), and each one of the at least collet finger 212A includes a tab 212B that engages the flow control member when the flow control member 208 is disposed in the closed position and when the flow control member 208 is disposed in the open position.

In some embodiments, for example, the flow control member 208 and the flow control member-engaging collet 212 are co-operatively configured so that engagement of the flow control member 208 and the flow control member-engaging collet 212 is effected while the flow control member 208 is disposed in the closed position and also when the flow control member 208 is disposed in the open position. In this respect, while the flow control member 208 is disposed in the closed position, the flow control member-engaging collet tab 212B is engaging (such as by being snapped into) a recess of the flow control member 208 such that interference or resistance is being effected to a change in position of the flow control member 208 from the closed position to the open position. In some embodiments, for example, the engagement is such that the flow control member-engaging collet 212 is retaining the flow control member 208 in the closed position, and a sufficient net opening force is required to be applied to the flow control member 208 to release the flow control member 208 from retention by the flow control member-engaging collet 212 and thereby effect opening of the flow control member 208. Also in this respect, while the flow control member 208 is disposed in the open position, the flow control member-engaging collet tab 212B is engaging (such as being snapped into) a recess of the flow control member 208 such that interference or resistance is being effected to a change in position of the flow control member 208 from the open position to the closed position. In some embodiments, for example, the engagement is such that the collet is retaining the flow control member 208 in the open position, and a sufficient net closing force is required to be applied to the flow control member 208 to release the flow control member 208 from retention by the flow control member-engaging collet 212 and thereby effect closing of the flow control member 208. In this respect, the flow control member-engaging collet 212 mitigates inadvertent opening and closing of the flow control member 208.

The housing 202 additionally defines a shoulder 214 to limit downhole displacement of the flow control member 208.

A shear pin 216 is provided to initially maintain the flow control member 208 in the closed position.

The flow control apparatus 201 includes a trigger for effecting displacement of the flow control member 208.

In this respect, the flow control apparatus 201 further includes a flow control member displacement actuator 218. The flow control member displacement actuator 218 is configured for effecting displacement of the flow control member 208 between the open position and the closed position. In some embodiments, for example, the displacement is effected based on a determination of a subsurface condition. After the displacement of the flow control member 208, by the flow control member displacement actuator 218, to the open position, a zone of the subterranean formation is stimulated by supplying treatment material through the opened at least one port 206.

In one aspect, the flow control displacement actuator 218 includes a pressurized fluid generator configured for generating a pressurized fluid for effecting the displacement of the flow control member 208 relative to the one or more ports 206. In some embodiments, for example, the generated pressurized fluid becomes disposed in communication with the flow control member 208 such that the displacement of the flow control member 208 relative to the one or more ports 106 is urged by the generated pressurized fluid.

In some embodiments, for example, the pressurized fluid is producible based on a determination of a subsurface condition. In some embodiments, for example, a pressurized fluid is producible, for effecting displacement of the flow control member from the closed position to the open position, based on a determination of a subsurface condition that is a flow control member opening condition, and a pressurized fluid is producible, for effecting displacement of the flow control member from the open position to the closed position, in response to a determination of a subsurface condition that is a flow control member closing condition.

Exemplary subsurface conditions that are flow control member opening conditions include: (a) a sensed signal that is transmitted from the surface (e.g. pressure pulse, seismic signal, voltage), (b) a sensed wellbore condition (e.g. pressure within the wellbore), (c) the completion of a wellbore stimulation stage (which, in some embodiments, for example, is based on at least sensing of a low pressure condition within the wellbore, which, for example, is associated with the shutting down of a pump which has supplied treatment material for the immediately preceding wellbore stimulation stage), (d) expiry of a predetermined time interval following completion of a wellbore stimulation stage (which, in some embodiments, for example, is based upon at least: (i) sensing of a low pressure condition within the wellbore, and (ii) a pre-programmed time interval following the sensing of the low pressure condition within the wellbore (for providing sufficient time to close the flow control member of another fluid communication station through whose opened port the immediately previous wellbore stimulation stage has been performed)), (e) the completion of a predetermined number of wellbore stimulation stages (which, in some embodiments, for example, is based on a count maintained of the number of previously completed wellbore stimulation stages), and (f) expiry of a predetermined time interval following completion of a predetermined number of wellbore stimulation stages (which, in some embodiments, for example, is based on: (i) a count maintained of the number of previously completed wellbore stimulation stages and (ii) a pre-programmed time interval following the sensing of the low pressure condition within the wellbore (for providing sufficient time to close the flow control member of another fluid communication station through whose opened port the immediately previous wellbore stimulation stage has been performed)).

Exemplary subsurface conditions that are flow control member closing conditions include: (a) a sensed signal that is transmitted from the surface (e.g. pressure pulse, seismic signal, voltage), (b) a sensed wellbore condition (e.g. pressure within the wellbore), (c) the completion of a wellbore stimulation stage (which, in some embodiments, for example, is based on at least sensing of a low pressure condition within the wellbore, which, for example, is associated with the shutting down of a pump which has supplied treatment material for the immediately preceding wellbore stimulation stage).

In some embodiments, for example, the pressurized fluid generator includes a source material that is converted into the pressurized fluid (such as the pressurized gaseous material) in response to a received signal. In some embodiments, for example, the conversion includes a chemical conversion.

In some embodiments, for example, the pressurized fluid generator is a gaseous material generator such that the pressurized fluid that is producible is a pressurized gaseous material.

In some embodiments, for example, the pressurized fluid generator includes an opening actuator 220 and a closing actuator 222.

The opening actuator 220 is configured for generating a pressurized fluid, such as a pressurized gaseous material, based on a determination of a subsurface condition that is a flow control member opening condition, for effecting displacement of the flow control member 208 from the closed position to the open position. In some embodiments, for example, the generated pressurized fluid becomes disposed in communication with the flow control member 208 such that the displacement of the flow control member 208 from the closed position to the open position is urged by the generated pressurized fluid. In some embodiments, for example, the opening actuator 220 includes a source material that is converted into the pressurized fluid (such as the pressurized gaseous material) based on a determination of a subsurface condition that is a flow control member opening condition. In some embodiments, for example, the conversion includes a chemical conversion. In some embodiments, for example, the opening actuator 220 includes a squib.

The closing actuator 222 is configured for generating a pressurized fluid, such as a pressurized gas, based on a determination of a subsurface condition that is a flow control member closing condition, for effecting displacement of the flow control member 208 from the open position to the closed position. In some embodiments, for example, the generated pressurized fluid becomes disposed in communication with the flow control member 208 such that the displacement of the flow control member 208 from the open position to the closed position is urged by the generated pressurized fluid. In some embodiments, for example, the closing actuator 222 includes a source material that is converted into the pressurized fluid (such as the pressurized gaseous material) based on a determination of a subsurface condition that is a flow control member opening condition. In some embodiments, for example, the conversion includes a chemical conversion. In some embodiments, for example, the closing actuator 222 includes a squib.

In some embodiments, for example, the opening actuator 220 includes a plurality of squibs, and the closing actuator 222 includes a plurality of squibs, such that the flow control member 220 is displaceable between open and closed conditions to effect multiple openings and closing of the at least one port 206.

In those embodiments where the flow control member displacement actuator 218 includes a pressurized fluid generator, and the pressurized fluid generator includes an opening actuator 220 and a closing actuator 222, in some of these embodiments, for example, the apparatus 201 further includes first and second chambers 224, 226. In some embodiments, for example, the first and second chambers 224, 226 are defined between the housing 202 and the flow control member 208. The first and second chambers 224, 226 are fluidically isolated, or substantially fluidically isolated, from the passage 204 by a combination of sealing members 228A, 228B, 210B, 210C, 232A, 232B co-operatively disposed to interfere with leakage between components. In some embodiments, for example, both of the first and second chambers 224, 226 are initially disposed at, or substantially at, atmospheric pressure.

The opening actuator 220, the first chamber 224, and the flow control member 208 are co-operatively configured such that, a pressurized fluid, producible by the opening actuator 220, is conductible to the first chamber 224 for communication to the flow control member 208 such that the displacement of the flow control member 208, from the closed position to the open position, is effectible by the pressurized fluid, disposed within the first chamber 224, and generated by the opening actuator 220.

The closing actuator 222, the second chamber 226, and the flow control member 208 are co-operatively configured such that, a pressurized fluid, producible by the closing actuator 222, is conductible to the second chamber 226 for communication to the flow control member 208 such that the displacement of the flow control member 208, from the open position to the closed position, is effectible by the pressurized fluid, disposed within the second chamber 226, and generated by the closing actuator 222.

In some embodiments, for example, the flow control member 208 includes a first fluid pressure responsive surface 208A. In this respect, the first fluid pressure responsive surface 208A is defined on the flow control member 208 and disposed in fluid communication with the first chamber 224 such that the fluid pressure responsive surface 208A receives application of fluid pressure from fluid disposed within the first chamber 224 (to at least contribute to the establishment of the sufficient net opening force, which thereby effects the displacement of the flow control member 208 from the closed position to the open position), such as the pressurized fluid that is generated by the opening actuator 220.

Likewise, in some embodiments, for example, the flow control member 208 includes a second fluid pressure responsive surface 208B. In this respect, the second fluid pressure responsive surface 208B is defined on the flow control member 208 and disposed in fluid communication with the second chamber 226 such that the fluid pressure responsive surface 208B receives application of fluid pressure from fluid disposed within the second chamber 226 (to at least contribute to the establishment of the sufficient net closing force, which thereby effects the displacement of the flow control member 208 from the opening position to the closed position), such as the pressurized fluid that is generated by the closing actuator 222.

When the flow control member opening force being applied to the flow control member 208 by fluid disposed within the first chamber 224 sufficiently exceeds the flow control member closing force being applied to the flow control member 208 by fluid disposed within the second chamber 226, the displacement of the flow control member 208 to the open position is effectible. In some embodiments, for example, the sufficient net opening force is effected by a sufficient fluid pressure differential between the first chamber 224 and the second chamber 226, wherein fluid pressure within the first chamber 224 exceeds fluid pressure within the second chamber 226.

When the flow control member closing force being applied to the flow control member 208 by fluid disposed within the second chamber 226 sufficiently exceeds the flow control member opening force being applied to the flow control member 208 by fluid disposed within the first chamber 224, the displacement of the flow control member 208 from the open position to the closed position is effectible. In some embodiments, for example, the sufficient net closing force is effected by a fluid pressure differential between the first chamber 224 and the second chamber 226, wherein fluid pressure within the second chamber 226 exceeds fluid pressure within the first chamber 224.

While the flow control member 208 is disposed in the closed position, in order for the pressurized fluid, generated by the opening actuator 220, to effect displacement of the flow control member 208 from the closed position to the open position, the opening actuator 220, the first chamber 224, and the second chamber 226 are co-operatively configured such that fluid flow from the first chamber 224 to the second chamber 226 is sufficiently restricted, such that, when the pressurized fluid is generated by the opening actuator 220 while the flow control member 208 is disposed in the closed position, conductibility, if any (in some embodiments, for example, and as explained below, the first and second chambers 224, 226 are fluidically isolated, or substantially fluidically isolated, from one another, so, in such cases, there is an absence, or substantial absence of conductibility (or flowability) of fluid between the first and second chambers 224, 226), of the fluid from the first chamber 224 to the second chamber 226 is at a sufficiently low rate such that a sufficient net opening force is maintained for a sufficient time duration to effect the displacement of the flow control member 208 from the closed position to the open position. In some embodiments, for example, the restriction to fluid flow from the first chamber 224 to the second chamber 226 is such that the first chamber 224 is fluidically isolated, or substantially fluidically isolated, relative to the second chamber 226, such that fluid flow from the first chamber 224 to the second chamber 226 is prevented or substantially prevented.

While the flow control member 208 is disposed in the open position, in order for the pressurized fluid, generated by the closing actuator 222, to effect displacement of the flow control member 208 from the open position to the closed position, the closing actuator 222, the second chamber 226, and the first chamber 224 are co-operatively configured such that fluid flow from the second chamber 226 to the first chamber 224 is sufficiently restricted, such that, when the pressurized fluid is generated by the closing actuator 222 while the flow control member 208 is disposed in the open position, conductibility, if any (in some embodiments, for example, and as explained below, the first and second chambers 224, 226 are fluidically isolated, or substantially fluidically isolated, from one another, so, in such cases, there is an absence, or substantial absence of conductibility (or flowability) of fluid between the first and second chambers 224, 226), of the fluid from the second chamber 226 to the first chamber 224 is at a sufficiently low rate such that a sufficient net closing force is maintained for a sufficient time duration to effect the displacement of the flow control member 208 from the open position to the closed position. In some embodiments, for example, the restriction to fluid flow from the second chamber 226 to the first chamber 224 is such that the second chamber 226 is fluidically isolated, or substantially fluidically isolated, relative to the first chamber 224, such that fluid flow from the second chamber 226 to the first chamber 224 is prevented or substantially prevented.

In some embodiments, for example, the fluidic isolation, or substantial fluidic isolation, of the first chamber 224 relative to the second chamber 226 is effected by a sealing interface 234, such that the apparatus 201 includes a sealing interface 234 for sealing, or substantially sealing, fluid communication between the first and second chambers 224, 226. In some embodiments, for example, the sealing interface 234 is defined by a pair of sealing members 236, 238 that are carried by the flow control member 208 and are disposed in sealing engagement with an internal surface of the housing 202 while the flow control member 208 is being displaced between the open position and the closed position. Co-operatively, in some embodiments, for example, the sealing members 236, 238 define a chamber 240 within which electronic components of the apparatus 201 are housed (see below).

Referring to FIG. 5, in some embodiments, for example, after the displacement of the flow control member 208 from the closed position to the open position, it may be desirable to return the flow control member 208 to the closed position, such as after a targeted zone has been stimulated through the one or more ports 206 that have become disposed in the open condition after the displacement of the flow control member 208 from the closed position to the open position.

In some embodiments, for example, in order to return the flow control member 208 to the closed position, it may be desirable to sufficiently dissipate fluid pressure from within the first chamber 224, prior to operating the closing actuator 222. Otherwise, a sufficient net closing force may not become established after the generation of the pressurized fluid by the closing actuator 222. In this respect, in some embodiments, for example, the first chamber 224 is fluidly coupled to a reservoir via a first passageway 242 for permitting depressurization of the first chamber 224 after the displacement of the flow control member 208 from the closed position to the open position, so as to remove interference to the return of the flow control member 208 to the closed position by the pressurized fluid that is generated by the closing actuator 222. In some of these embodiments, for example, the passage 204 defines the reservoir, such that the first passageway 242 effects fluid coupling between the first chamber 224 and the passage 204. In some embodiments, for example, the first passageway 242 includes an orifice that effects a flow restriction.

However, the dissipation of fluid pressure from the first chamber 224 must not be effectible at an excessively high rate. Otherwise, the flow control member 208 may fail to become displaced to the open position. In this respect, to mitigate this, the opening actuator 220, the first chamber 224, and the first passageway 242 are co-operatively configured such that, when the pressurized fluid is generated by the opening actuator 220 while the flow control member 208 is disposed in the closed position, the conductibility of the fluid from the first chamber 224 via the first passageway 242 is at a sufficiently low rate such that a sufficient net opening force is maintained for a sufficient time duration to effect the displacement of the flow control member 208 from the closed position to the open position. In some of these embodiments, for example, the first chamber 224 is also disposed in fluid communication with the second chamber 226 via a chamber-communicating passageway (not shown), and, in this respect, the opening actuator 220, the first chamber 224, the first passageway 242, the chamber-communicating passageway, and the second chamber 226 are co-operatively configured such that when the pressurized fluid is generated by the opening actuator 220 while the flow control member 208 is disposed in the closed position, the conductibility of the fluid from the first chamber 224, via at least both of the first passageway 242 and the chamber-communicating passageway, is at a sufficiently low rate such that a sufficient net opening force is maintained for a sufficient time duration to effect the displacement of the flow control member 208 from the closed position to the open position.

Also referring to FIG. 5, in some embodiments, for example, after the displacement of the flow control member 208 from the open position to the closed position, it may be desirable to return the flow control member 208 to the open position, such as when it is desirable to effect fluid communication with a previously-stimulated zone to enable production from such zone.

In some embodiments, for example, in order to return the flow control member 208 to the open position, it may be desirable to sufficiently dissipate fluid pressure from within the second chamber 226, prior to operating the opening actuator 220. Otherwise, a sufficient net opening force may not become established by the generation of the pressurized fluid by the opening actuator 220. In this respect, in some embodiments, for example, the second chamber 226 is fluidly coupled to a reservoir via a second passageway 244 for permitting depressurization of the second chamber 226 after the displacement of the flow control member 208 from the open position to the closed position, so as to remove interference to the return of the flow control member to the open position by the pressurized fluid that is generated by the opening actuator 220. In some of these embodiments, for example, the passage 204 defines the reservoir, such that the second passageway 244 effects fluid coupling between the second chamber 226 and the passage 204. In some embodiments, for example, the second passageway 244 includes an orifice that effects a flow restriction.

However, the dissipation of fluid pressure from the second chamber 226 must not be effectible at an excessively high rate. Otherwise, the flow control member 208 may fail to become displaced to the closed position. In this respect, to mitigate this, the closing actuator 222, the second chamber 226, and the second passageway 244 are co-operatively configured such that, when the pressurized fluid is generated by the closing actuator 222 while the flow control member 208 is disposed in the open position, the conductibility of the fluid from the second chamber 226 via the second passageway 244 is at a sufficiently low rate such that a sufficient net closing force is maintained for a sufficient time duration to effect the displacement of the flow control member 208 from the open position to the closed position. In some of these embodiments, for example, the second chamber 226 is also disposed in fluid communication with the first chamber 224 via a chamber-communicating passageway (not shown), and, in this respect, the closing actuator 222, the first chamber 224, the second passageway 244, the chamber-communicating passageway, and the second chamber 226 are co-operatively configured such that when the pressurized fluid is generated by the closing actuator 222 while the flow control member 208 is disposed in the open position, the conductibility of the fluid from the second chamber 226, via at least both of the second passageway 244 and the chamber-communicating passageway, is at a sufficiently low rate such that a sufficient net closing force is maintained for a sufficient time duration to effect the displacement of the flow control member 208 from the open position to the closed position.

In some embodiments, for example, both of the first and second passageways 244 are provided, and the first and second chambers 224, 226 are disposed in fluid communication with one another via the chamber-communicating passageway. In this respect, in order to return the flow control member 208 to the closed position, while also ensuring that sufficient fluid pressure is maintained within the first chamber 224 in order for the flow control member 208 to become displaced to the open position, the opening actuator 220, the first chamber 224, the first passageway 242, the chamber-communicating passageway, the second chamber 226 and the second passageway 244 are co-operatively configured such that when the pressurized fluid is generated by the opening actuator 220 while the flow control member 208 is disposed in the closed position, the conductibility of the fluid from the first chamber 224, via the first passageway 242, and also via the chamber-communicating passageway, the second chamber 226, and the second passageway 244, is at a sufficiently low rate such that a sufficient net opening force is maintained for a sufficient time duration to effect the displacement of the flow control member 208 from the closed position to the open position. Also in this respect, in order to return the flow control member 208 to the open position, while also ensuring that sufficient fluid pressure is maintained within the second chamber 226 in order for the flow control member 208 to become displaced to the closed position, the closing actuator 222, the first chamber 224, the first passageway 242, the chamber-communicating passageway, the second chamber 226 and the second passageway 244 are co-operatively configured such that when the pressurized fluid is generated by the closing actuator 222 while the flow control member 208 is disposed in the open position, the conductibility of the fluid from the second chamber 226, via the second passageway 244, and also via the chamber-communicating passageway, the first chamber 224, and the first passageway 242, is at a sufficiently low rate such that a sufficient net closing force is maintained for a sufficient time duration to effect the displacement of the flow control member 208 from the open position to the closed position.

In some embodiments, for example, the first and second passageways 242, 244 are unnecessary in order to effect the necessary pressure dissipation from the first and second chambers 224, 226, respectively. In those embodiments where the pressurized fluid is generated by a squib, the temperature of the generated pressurized fluid is relatively high, and that, upon cooling, the pressure within the respective chamber becomes sufficiently dissipated, such that the residual pressure does not interfere with further displacement of the flow control member 208.

In some embodiments, for example, the apparatus 201 includes a controller 248, and the determination of a subsurface condition is effectible by the controller 248. In this respect, the controller 248 is configured to operate the flow control member displacement actuator 218 to effect the displacement of the flow control member 208 from the closed position to the open position based on the determination, by the controller 248, of a subsurface condition that is a flow control member opening condition, and is also configured to operate the flow control member displacement actuator 218 to effect the displacement of the flow control member 208 from the open position to the closed position based on the determination, by the controller 248, of a subsurface condition that is a flow control member closing condition In those embodiments where the flow control member displacement actuator 218 includes an opening actuator 220 and a closing actuator 222, in some of embodiments, for example, both of the opening and closing actuators 220, 222 are coupled to the controller 248. The controller 248 is configured to, based on the determination of a subsurface condition that is a flow control member opening condition, operate the opening actuator 220 to effect the generation of pressurized fluid within the first chamber 224. Likewise, the controller 248 is configured to, based on the determination of a subsurface condition that is a flow control member closing condition, to operate the closing actuator 222 to effect the generation of pressurized fluid within the second chamber 226.

In some embodiments, for example, the apparatus 201 further includes a sensor 246 for sensing a subsurface condition, such as a transmitted signal or a wellbore fluid characteristic (such as wellbore fluid pressure). Exemplary signals include a signal transmitted through the wellbore fluid, a signal transmitted through the wellbore string, a signal transmitted through the ground, and a signal transmitted through a cable or wire. The sensor 246 is coupled to the controller for transmitting a signal based on the sensing of a subsurface condition.

In some embodiments, for example, the determination of a flow control member opening condition by the controller 248 is based upon, at least in part, sensing of a flow control member opening signal by the sensor 246. In some of these embodiments, for example, the flow control member opening signal is defined by a mechanical wave. In this respect, in some embodiments, for example, the flow control member opening signal is defined by a pressure pulse characterized by at least a magnitude. In some embodiments, for example, the pressure pulse is further characterized by at least a duration. In some embodiments, for example, the flow control member-opening signal is defined by a pressure pulse characterized by at least a duration. In some embodiments, for example, the flow control member opening signal is defined by a plurality of pressure pulses. In some embodiments, for example, the flow control member opening signal is defined by a plurality of pressure pulses, each one of the pressure pulses characterized by at least a magnitude. In some embodiments, for example, the flow control member opening signal is defined by a plurality of pressure pulses, each one of the pressure pulses characterized by at least a magnitude and a duration. In some embodiments, for example, the flow control member opening signal is defined by a plurality of pressure pulses, each one of the pressure pulses characterized by at least a duration. In some embodiments, for example, each one of pressure pulses is characterized by time intervals between the pulses. In some embodiments, for example, the flow control member opening signal is one of, or any combination of, descending pressure steps, increasing-decreasing pressure steps, square wave pressure steps. In some embodiments, for example, the flow control member opening signal is generated by a seismic source. In some embodiments, for example, the seismic source includes a seismic vibrator unit. In some of these embodiments, for example, the seismic vibration unit is disposed at the surface 10.

Likewise, in some embodiments, for example, the determination of a flow control member closing condition by the controller 248 is based upon, at least in part, sensing of a flow control member closing signal by the sensor 246. In some of these embodiments, for example, the flow control member closing signal is defined by a mechanical wave. In this respect, in some embodiments, for example, the flow control member closing signal is defined by a pressure pulse characterized by at least a magnitude. In some embodiments, for example, the pressure pulse is further characterized by at least a duration. In some embodiments, for example, the flow control member-closing signal is defined by a pressure pulse characterized by at least a duration. In some embodiments, for example, the flow control member closing signal is defined by a plurality of pressure pulses. In some embodiments, for example, the flow control member closing signal is defined by a plurality of pressure pulses, each one of the pressure pulses characterized by at least a magnitude. In some embodiments, for example, the flow control member closing signal is defined by a plurality of pressure pulses, each one of the pressure pulses characterized by at least a magnitude and a duration. In some embodiments, for example, the flow control member closing signal is defined by a plurality of pressure pulses, each one of the pressure pulses characterized by at least a duration. In some embodiments, for example, each one of pressure pulses is characterized by time intervals between the pulses. In some embodiments, for example, each one of pressure pulses is characterized by time intervals between the pulses. In some embodiments, for example, the flow control member opening signal is one of, or any combination of, descending pressure steps, increasing-decreasing pressure steps, square wave pressure steps. In some embodiments, for example, the flow control member closing signal is generated by a seismic source. In some embodiments, for example, the seismic source includes a seismic vibrator unit. In some of these embodiments, for example, the seismic vibration unit is disposed at the surface 10.

In some embodiments, for example, the sensor 246 is disposed in fluid pressure communication with the apparatus passage 204. In this respect, in some embodiments, for example, the sensor 246 is mounted to the housing 202. In some embodiments, for example, the sensor 246 is a pressure sensor 246, and each one of the flow control member opening and closing signals, independently, is a respective one or more pressure pulses. An exemplary pressure sensor 246 is a Kellar Pressure Transducer Model 6LHP/81188™.

Other suitable sensors 246 may be employed, depending on the nature of the signal being used for the valve-opening signal. Other suitable sensors 246 include a Hall effect sensor 246, a radio frequency identification ("RFID") sensor 246, or a sensor 246 that can detect a change in chemistry (such as, for example, pH), or radiation levels, or ultrasonic waves.

In some embodiments, for example, the controller 248 and the sensor 246 are powered by a battery 250, and these components are carried by the flow control member 208 and housed within an atmospheric chamber defined between the housing and the flow control member 208, such as, for example, the chamber 240 (see above). Passages (not shown) are also provided for wiring for electrically interconnecting the battery 250, the sensor 246, the controller 248 and the flow control member displacement actuator 218.

In another aspect, the apparatus 201 is configured for actuating the flow control member 208 of a flow communication station 200B based on a determination, by the controller 248, that a wellbore stimulation of a zone of the subterranean formation 100 via another flow communication station 200A has been completed (i.e. a wellbore stimulation stage has been completed). In some embodiments, for example, this determination is based on at least sensing of pressure within the wellbore 102, such as, for example, by the sensor 246.

In some embodiments, for example, the apparatus 201 is configured for actuating the flow control member 208 of a flow communication station 200B based on a determination, by the controller 248, that a predetermined time interval has expired following completion of a wellbore stimulation stage. In some embodiments, for example, this determination is based on, in part, sensing of pressure within the wellbore 102, such as, for example, by the sensor 246. The predetermined time interval functions as a delay for providing sufficient time to close the flow control member of another fluid communication station (e.g. 200A) through whose opened port the immediately previous wellbore stimulation stage has been performed.

In some embodiments, for example, the apparatus 201 is configured for actuating the flow control member 208 of a flow communication station 200B based on a determination, by the controller 248, that a predetermined number of wellbore stimulation stages has been completed. In this respect, the controller 248 is configured to maintain a count of completed wellbore stimulation stages. In some embodiments, for example, the count is incremented for each determination of a completion of a wellbore stimulation stage. In some embodiments, for example, each determination of a completion of a wellbore stimulation stage is based on at least sensing of pressure within the wellbore 102, such as, for example, by the sensor 246.

In some embodiments, for example, the apparatus 201 is configured for actuating the flow control member 208 of a flow communication station 200B based on a determination, by the controller 248, that a predetermined time interval has expired following completion of a predetermined number of wellbore stimulation stages. In some embodiments, for example, this determination is based on, in part, sensing of pressure within the wellbore 102, such as, for example, by the sensor 246. The predetermined time interval functions as a delay for providing sufficient time to close the flow control member of another fluid communication station through whose opened port the immediately previous wellbore stimulation stage has been performed.

In another aspect, a method of stimulating a subterranean formation 100 for the production of hydrocarbon material is provided, and includes stimulating, in a sequence of stages, a plurality of zones of the subterranean formation 100. The method includes stimulating a first zone of the subterranean formation 100 by supplying treatment material via a first fluid communication station 200A. Upon completion of the stimulation of the first zone, indicated by, for example, the shutting down of a pump which has been supplying treatment material to the first zone, which, in turn, results in a drop in pressure within the wellbore 102, a determination, by a controller 248 of the second fluid communication station 200B, is made that a stimulation of a wellbore completion stage has been completed (in some embodiments, for example, based on the sensing of a pressure within the wellbore 102 by the sensor 246 of the second fluid communication stations 200B). Based on this determination, the flow control member 208 of the second fluid communication station is displaced from the closed position to the open position by the opening actuator 220 such that the at least one port 206 of the second fluid communication station 200B becomes opened, thereby enabling the stimulation of a second zone of the subterranean formation 100 via the second fluid communication station 200B. Treatment fluid is then supplied to the second zone via the at least one opened port 206 of the second fluid communication station 200B.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A method of stimulating production from a subterranean formation comprising:

generating gaseous material with a downhole gas generator by chemically converting a source material into the gaseous material, such that the generated gaseous material becomes disposed in fluid communication with a flow control member of a fluid communication station disposed within a wellbore of the subterranean formation; and displacing the flow control member, relative to a port, with the generated gaseous material, such that the port becomes opened; and stimulating the subterranean formation via the opened port.

2. The method as claimed in claim 1;

wherein the generating is triggered by a controller based on the determination of a subsurface condition.

3. The method as claimed in claim 1;

wherein the downhole gas generator is a squib.

4. A method of stimulating production from a subterranean formation comprising:

deploying a first fluid communication station and a second fluid communication station within a wellbore of the subterranean formation, wherein each one of the first and second fluid communication stations, independently, is configured to selectively establish fluid communication between the wellbore and the subterranean formation;

generating a first gaseous material with a first downhole gas generator such that the generated first gaseous material becomes disposed in fluid communication with a flow control member of the first fluid communication station while fluid communication between the generated first gaseous material and a flow control member of the second fluid communication station is sealed or substantially sealed, such that displacement of the flow control member of the first fluid communication station, relative to a first port, is effected by the generated first gaseous material, such that the first port becomes opened and fluid communication is established between the wellbore and the subterranean formation via the first fluid communication station;

after the fluid communication is established between the wellbore and the subterranean formation via the first fluid communication station, stimulating the subterranean formation via the first fluid communication station;

generating a second gaseous material with a second downhole gas generator such that the generated second gaseous material becomes disposed in fluid communication with the flow control member of the first fluid communication station while fluid communication between the generated second gaseous material and the flow control member of the second fluid communication station is sealed or substantially sealed, such that displacement of the flow control member of the first fluid communication station, relative to the first port, is effected by the generated second gaseous material, such that the first port becomes closed and fluid communication between the wellbore and the subterranean formation, via the first fluid communication station, becomes sealed or substantially sealed;

generating a third gaseous material with a third downhole gas generator such that the generated third gaseous material becomes disposed in fluid communication with the flow control member of the second fluid communication station while fluid communication between the generated third gaseous material and the flow control member of the first fluid communication station is sealed or substantially sealed, such that displacement of the flow control member of the second fluid communication station, relative to a second port, is effected by the generated third gaseous material, such that the second port becomes opened and fluid communication is established between the wellbore and the subterranean formation via the second fluid communication station;

after the fluid communication is established between the wellbore and the subterranean formation via the second fluid communication station, stimulating the subterranean formation via the second fluid communication station; and generating a fourth gaseous material with a fourth downhole gas generator such that the generated fourth gaseous material becomes disposed in fluid communication with the flow control member of the second fluid communication station while fluid communication between the generated fourth gaseous material and the flow control member of the first fluid communication station is sealed or substantially sealed, such that displacement of the flow control member of the second fluid communication station, relative to the second port, is effected by the generated fourth gaseous material, such that the second port becomes closed and fluid communication between the wellbore and the subterranean formation, via the second fluid communication station, becomes sealed or substantially sealed.

* * * * *